US008220587B2

(12) United States Patent
Mori et al.

(10) Patent No.: US 8,220,587 B2
(45) Date of Patent: Jul. 17, 2012

(54) SILENCER COVER FOR SADDLE-RIDE TYPE VEHICLE

(75) Inventors: Taichi Mori, Wako (JP); Hayato Yamazaki, Wako (JP); Masashi Koyanagi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/637,366

(22) Filed: Dec. 14, 2009

(65) Prior Publication Data

US 2010/0193285 A1 Aug. 5, 2010

(30) Foreign Application Priority Data

Jan. 30, 2009 (JP) ..... 2009-020723

(51) Int. Cl.

| | |
|---|---|
| ***F01N 1/00*** | (2006.01) |
| ***F01N 1/02*** | (2006.01) |
| ***F01N 1/08*** | (2006.01) |
| ***F01N 5/00*** | (2006.01) |
| ***F01N 5/02*** | (2006.01) |
| ***F01N 13/08*** | (2010.01) |
| ***F01N 13/18*** | (2010.01) |

(52) U.S. Cl. ..... 181/251; 181/211; 181/212; 181/227; 181/241; 181/272; 181/282; 60/272; 60/322

(58) Field of Classification Search ..... 181/251, 181/211, 227, 241, 272; 60/272
See application file for complete search history.

(56) References Cited

U.S. PATENT DOCUMENTS

| | | | | |
|---|---|---|---|---|
| 3,677,364 | A * | 7/1972 | Pawlina | 181/269 |
| 4,085,816 | A * | 4/1978 | Amagai et al. | 180/89.2 |
| 4,478,310 | A * | 10/1984 | Harter | 181/241 |
| 5,036,947 | A * | 8/1991 | Metzger | 181/241 |
| 5,683,277 | A * | 11/1997 | Tsunoda et al. | 440/88 R |
| 5,708,238 | A * | 1/1998 | Asao et al. | 181/272 |
| 5,844,177 | A * | 12/1998 | Pirchl | 181/211 |
| 5,898,140 | A * | 4/1999 | Asao et al. | 181/272 |

(Continued)

FOREIGN PATENT DOCUMENTS

EP 1464824 A1 10/2004

(Continued)

OTHER PUBLICATIONS

European Search Report dated Jun. 4, 2010, issued in corresponding European Patent Application No. 10151918.9.

*Primary Examiner* — Elvin G Enad
*Assistant Examiner* — Christina Russell
(74) *Attorney, Agent, or Firm* — Westerman, Hattori, Daniels & Adrian, LLP

(57) ABSTRACT

A silencer cover adapts to a heat expansion of a silencer even when, for example, the silencer cover has a large size and is attached to the silencer over an area from the front to the rear. A silencer cover is provided for a silencer connected to a downstream end of an exhaust pipe of an engine. The silencer cover is fixed to a fixing support provided to the silencer. The silencer is heat-expanded with the fixing support part fixed as a base. The fixing support part is provided at a front end portion, in a vehicle front-rear direction, of the silencer. With a tail pipe constituting a rear end portion of the silencer, the rear end portion of the silencer is provided with a slide structure in which the silencer cover is slidably supported.

9 Claims, 7 Drawing Sheets

U.S. PATENT DOCUMENTS

| | | | | |
|---|---|---|---|---|
| 5,951,344 | A * | 9/1999 | Tsunoda et al. | 123/572 |
| 5,966,933 | A * | 10/1999 | Ishihara et al. | 60/322 |
| 6,584,768 | B1 * | 7/2003 | Hecker et al. | 60/297 |
| 2004/0154860 | A1 * | 8/2004 | Joost et al. | 181/258 |
| 2006/0042871 | A1 * | 3/2006 | Yasuda et al. | 181/227 |
| 2006/0249328 | A1 * | 11/2006 | Ichikawa et al. | 181/254 |
| 2008/0098721 | A1 * | 5/2008 | Liu | 60/272 |
| 2010/0192880 | A1 * | 8/2010 | Koyanagi et al. | 123/54.4 |

FOREIGN PATENT DOCUMENTS

| | | | |
|---|---|---|---|
| EP | 2136042 | A1 | 12/2009 |
| JP | 2008-095509 | A | 4/2008 |

* cited by examiner

SILENCER COVER FOR SADDLE-RIDE TYPE VEHICLE

TECHNICAL FIELD

The present invention relates to an improvement in a silencer cover for a saddle-ride type vehicle.

BACKGROUND OF THE INVENTION

For a motorcycle, a silencer cover covering a top surface and an outer side surface of a silencer is known (for example, see Japanese Patent Application Publication No. 2008-99509, FIGS. 3 and 4).

In FIG. 4 of Japanese Patent Application Publication No. 2008-99509, an outer side surface of an exhaust muffler is covered by a protector (referred to as the "silencer cover" below). The silencer cover is formed of a first protector member made of a metal and a second protector member made of a synthetic resin and covering the first protector member from an outer side.

In FIG. 3 of Japanese Patent Application Publication No. 2008-99509, the first protector member and the second protector member are together fastened and supported, at their front portions, to a front portion of the silencer with a bolt, and are together fastened and supported, at their rear portions, to a rear portion of the silencer.

SUMMARY OF THE INVENTION

When the silencer cover is a tubular member which is long in a front-rear direction and the front and rear portions of which are supported by the silencer, a consideration needs to be paid to a heat-expansion difference between the silencer and the silencer cover.

A silencer cover adapts to a heat expansion of a silencer even when, for example, the silencer cover has a large size and is attached to the silencer over an area from the front to the rear.

A first aspect provides a silencer apparatus for a saddle-ride type vehicle provided for a silencer connected to a downstream end of an exhaust pipe of an engine. In the silencer cover, at least one point of plurality of points at which the silencer cover is attached to the silencer employs a slide structure.

A second aspect provides the silencer apparatus characterized as follows. The silencer is provided with a fixing support part for supporting the silencer cover, and the support part is provided at a front end potion, in a vehicle front-rear direction, of the silencer.

A third aspect provides the silencer apparatus characterized as follows. The slide structure is provided at a rear end portion of the silencer.

A fourth aspect provides the silencer apparatus characterized as follows. The slide structure is provided to a tail pipe.

A fifth aspect provides the silencer apparatus characterized as follows. A mesh spacer is placed between the rear end portion of the silencer and the silencer cover.

A sixth aspect provides the silencer apparatus characterized as follows. The silencer is formed of a first cover part constituting a front part and a second cover part behind the first cover part. The fixing support part is provided to the first cover part. The slide structure is provided to the second cover part. The first cover part and the second cover part are connected to each other with an elastic member therebetween.

According to the first aspect, at least one point of plurality of points at which the silencer cover is attached employs a slide structure. Accordingly, when being heat-expanded, the silencer can move relative to the silencer cover, allowing the silencer cover to adapt to the heat expansion of the silencer.

According to the second aspect, the silencer is provided with the fixing support part for supporting the silencer cover, and the support part is provided at the front end potion of the silencer. The silencer cover is placed so that portions other than the support part may have a clearance from the silencer. This makes it hard for heat of the silencer to be transmitted to the silencer cover, and also makes it hard for vibrations of the silencer to be transmitted to the silencer cover.

According to the third aspect, the slide structure is provided at the rear end portion of the silencer. The silencer cover is fixed with the support part provided at the front end portion of the silencer. With the slide structure provided to the rear end portion of the silencer, the silencer is made slidable relative to the silencer cover. Accordingly, the silencer cover can be supported in a balanced manner, allowing a smooth heat expansion of the silencer between the silencer and the silencer cover.

According to the fourth aspect, the slide structure is provided to the tail pipe. Accordingly, there is no need for an additional member such as a stay. Consequently, the structure for allowing the silencer to be slidable is made simple, preventing an increase in the number of components.

According to the fifth aspect, the mesh spacer as a buffer is placed between the rear end portion of the silencer and the silencer cover.

By being placed between the tail pipe and the silencer cover, the mesh spacer acts as a buffer to fill the space formed between the silencer cover and the silencer. Accordingly, vibrations and sound can be reduced.

According to the sixth aspect, the first cover part provided with the fixing support part and the second cover part provided with the slide structure are connected to each other with the elastic member therebetween. This makes it harder for that vibrations from the first cover part provided with the fixing support part to be transmitted to the silencer cover.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
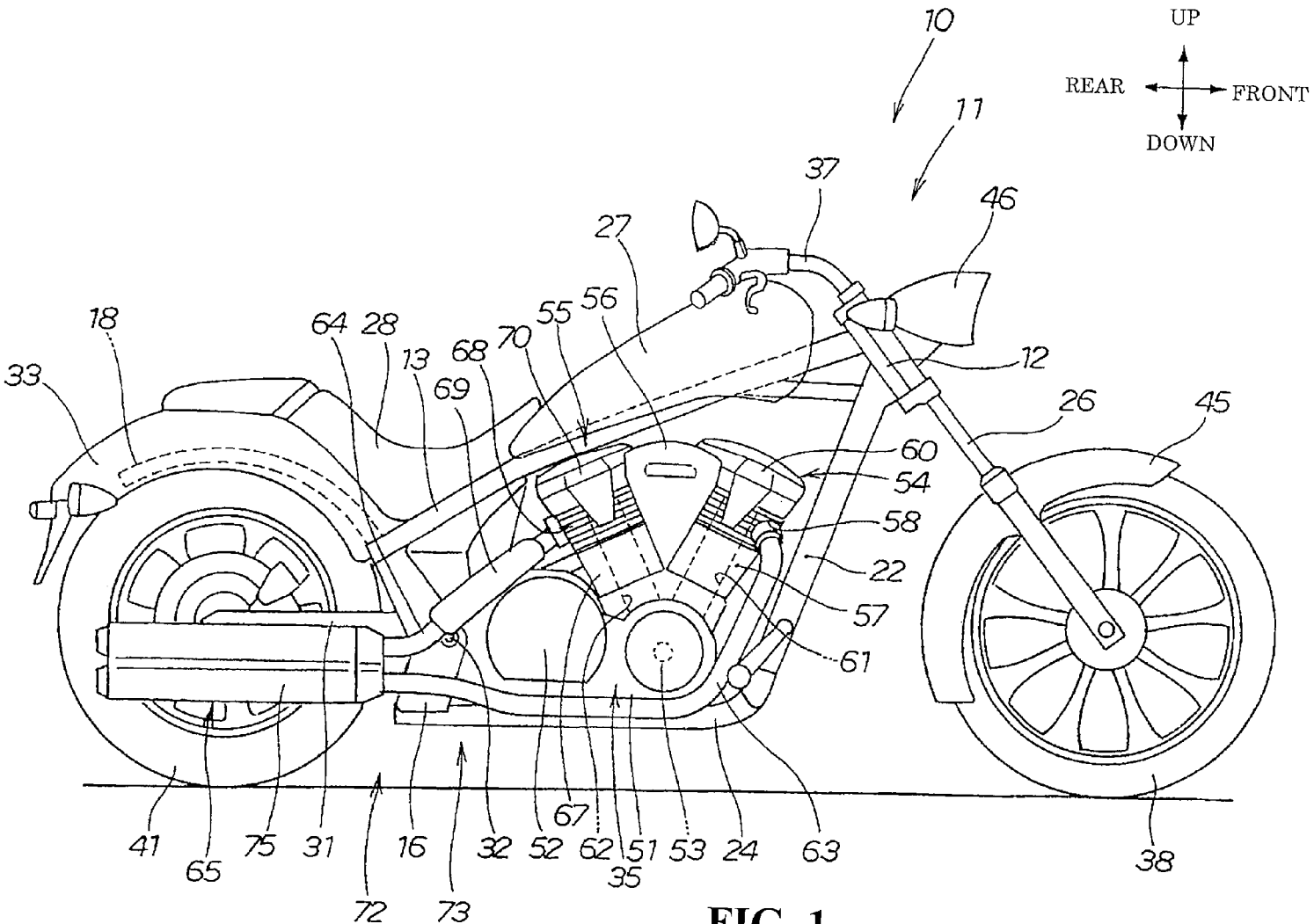
FIG. 1 is a right-side view of a saddle-ride type vehicle according to the present invention.

An embodiment of the present invention is described in detail below. The "front," "rear," "left," "right," "up," and "down" in the drawings are directions as viewed from the rider on the saddle-ride type vehicle. Note that the drawings are to be viewed according to the orientation of the reference numerals.

In FIG. 1, a motorcycle 10 being a saddle-ride type vehicle is a vehicle having the following structure. A body frame 11 of the motorcycle 10 includes a head pipe 12 provided at a front end, a main frame 13, paired left and right pivot frames 15, 16 (only reference numeral 16 on the near side is shown), paired left and right rear frames 17 and 18 (only reference numeral 18 on the near side is shown), paired left and right down frames 21, 22 (only reference numeral 22 on the near side is shown), and paired left and right lower frames 23, 24 (only reference numeral 24 on the near side is shown). The main frame 13 extends from the head pipe 12 rearward and obliquely downward. The pivot frames 15, 16 and the rear frames 17, 18 are attached to a rear end portion of the main frame 13. The down frames 21, 22 extend from the head pipe 12 rearward and obliquely downward below the main frame 13. Each of the lower frames 23, 24 extends integrally from a lower end of a corresponding one of the down frames 21, 22 rearward, and is joined to a lower end of a corresponding one of the pivot frames 15, 16. A front fork 26 is steerably attached to the head pipe 12. A fuel tank 27 and a rider's seat 28 are attached to an upper portion of the main frame 13. A swing arm 31 is swingably attached to the pivot frames 15, 16 through a pivot shaft 32. A rear fender 33 is attached to the rear frames 17, 18. A V-type engine 35 (also called the "engine 35" below) is attached to the down frames 21, 22 and the lower frames 23, 24. A handlebar 37 and a front wheel 38 are attached to the front fork 26 at its upper end and at its lower end, respectively. A rear wheel 41 is attached to a rear end of the swing arm 31.

Further, the front fork 26 is provided with a head lamp 46 at its upper portion, and with a front fender 45 at its middle portion to cover the front wheel 38 from above.

The engine 35 is a power unit integrally including a transmission 52 behind a crankcase 51. A crankshaft 53 extends in the crankcase 51 in a vehicle-width direction. The engine 35 has a front cylinder part 54 (also called the "front bank 54" below) extending from the crankshaft 53 upward and obliquely frontward and a rear cylinder part 55 (also called the "rear bank 55" below) extending from the crankshaft 53 upward and obliquely rearward.

A fuel supply device 56 is placed between the front cylinder part 54 and the rear cylinder part 55 to supply a mixture of gas to the front cylinder part 54 and to the rear cylinder part 55.

The front cylinder part 54 includes a front cylinder block 57, a front cylinder head 58, a front head cover (not shown), and a front overhead cover 60. The front cylinder block 57 is attached to an upper front portion of the crankcase 51, and the front cylinder head 58 is attached to an upper portion of the front cylinder block 57. The front head cover covers the front cylinder head 58 from above, and the front overhead cover 60 covers around the front head cover. With the structure described above, a front cylinder 61 as a fuel chamber is formed in the front cylinder part 54.

A front exhaust pipe 63 extends from the front cylinder 61 downward and then rearward. A rear end portion of the front exhaust pipe 63 is connected to a silencer 65 that constitutes expansion chambers.

The rear cylinder part 55 includes a rear cylinder block 67, a rear cylinder head 68, a rear head cover (not shown), and a rear overhead cover 70. The rear cylinder block 67 is attached to an upper rear portion of the crankcase 51, and the rear cylinder head 68 is attached to an upper portion of the rear cylinder block 67. The rear head cover covers the rear cylinder head 68 from above, and the rear overhead cover 70 covers around the rear head cover. With the structure described above, a rear cylinder 62 as a fuel chamber is formed in the rear cylinder part 55.

A rear exhaust pipe 64 extends from the rear cylinder 62 rearward. A rear end portion of the rear exhaust pipe 64 is connected to the silencer 65. Reference numeral 69 denotes a protector.

As described, in the present embodiment, the multicylinder engine is the V-type two-cylinder engine 35 including the front cylinder 61 and the rear cylinder 62, in which the crankshaft 53 extends in the vehicle-width direction.

The V-type two-cylinder engine 35 has an exhauster 72 constituting an exhaust system. The exhauster 72 includes an exhaust pipe 73, the silencer 65, and a silencer cover 75. The exhaust pipe 73 extends from the engine 35, and the silencer 65 is connected to a downstream end of the exhaust pipe 73. The silencer cover 75 covers the silencer 65.

Note that the exhaust pipe 73 includes the front exhaust pipe 63 extending from the front cylinder part 54 of the engine 35, and the rear exhaust pipe 64 extending from the rear cylinder part 55 of the engine 35.

In the present embodiment, the multicylinder engine is a narrow-angle, V-type two-cylinder engine. It should be noted, however, that the multicylinder engine may have any number of cylinders, such as three cylinders, four cylinders, five cylinders, and six cylinders. Moreover, the type of the multicylinder engine is not limited to a V type, and the multicylinder engine may be a horizontally-opposed engine, an in-line engine, or an engine of other types.

Figure 2:
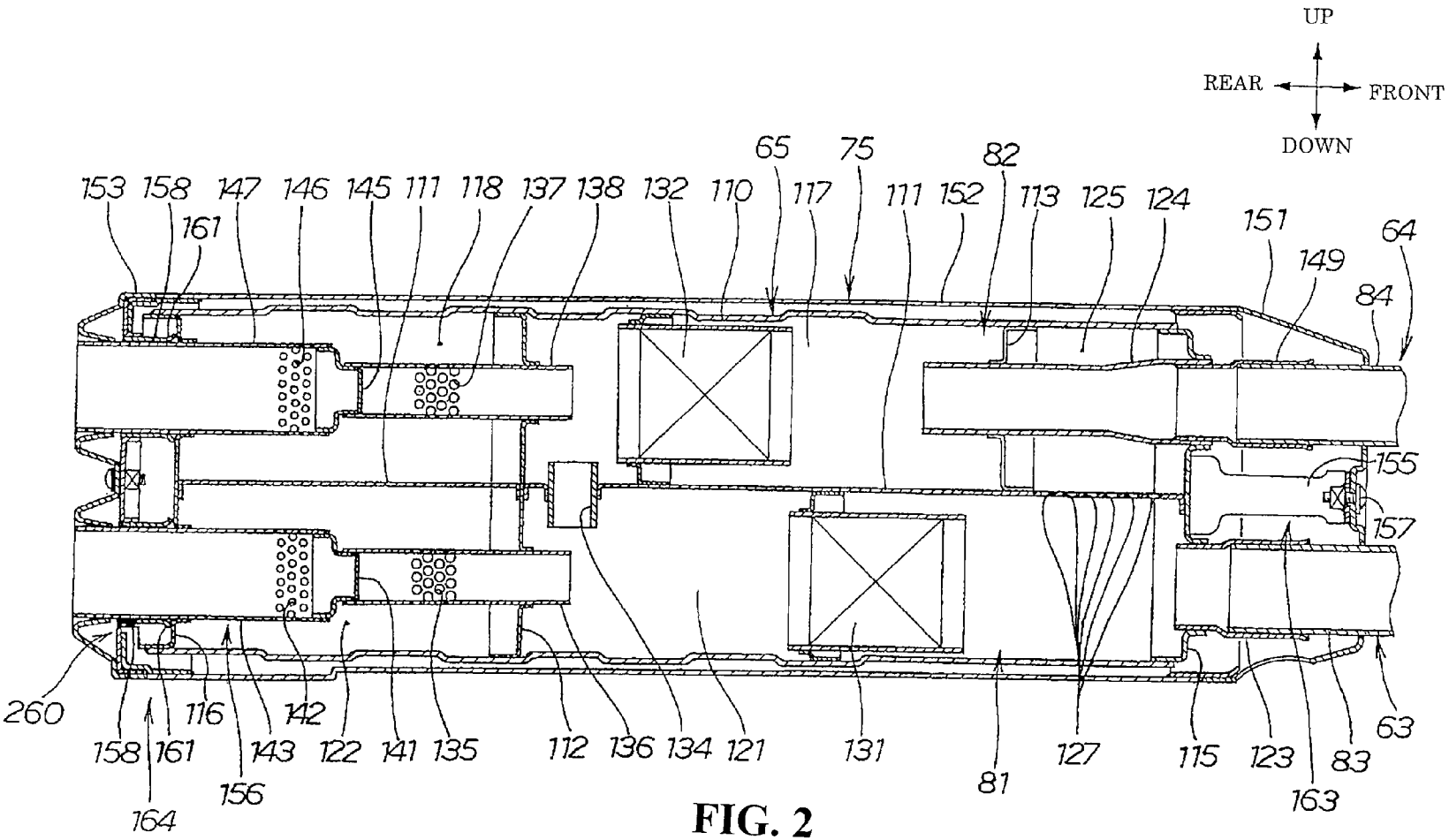
FIG. 2 is a cross-sectional view taken along the side of a silencer included in the saddle-ride type vehicle according to the present invention.

In FIG. 2, the silencer 65 is divided vertically to have a lower-side expansion path 81 and an upper-side expansion path 82. A rear end portion 83 of the front exhaust pipe 63 is connected to the lower-side expansion path 81, while a rear end portion 84 of the rear exhaust pipe 64 is connected to the upper-side expansion path 82.

A detailed structure of the silencer 65 is described below. The main structure of the silencer 65 is as follows. The silencer 65 includes an outer casing 110, a first separator 111, a front wall part 115, a rear wall part 116, a second separator 112, a first input pipe 123, a third separator 113, a second input pipe 124, through holes 127, a first catalyst unit 131, a second catalyst unit 132, a communication hole 134, a lower joining pipe 136, an upper joining pipe 138, a lower tail pipe 143, and an upper tail pipe 147. Specifically, the first separator 111 divides the outer casing 110 into the lower-side expansion path 81 and the upper-side expansion path 82. The outer casing 110 is sealed by the front wall part 115 and the rear wall part 116 at a front end portion and a rear end portion, respectively. Between the front wall part 115 and the rear wall part 116, the second separator 112 divides the upper expansion path 82 into an upper first chamber 117 and an upper second chamber 118, and divides the lower expansion path 81 into a lower first chamber 121 and a lower second chamber 122. The first input pipe 123 penetrates the front wall part 115 and extends in an axial direction of the outer casing 110 to the lower first chamber 121, while being connected to the rear end portion 83 of the front exhaust pipe 63 to supply an exhaust gas exhausted from the front bank 54, to the lower first chamber 121. The third separator 113 is placed between the front wall part 115 and the second separator 112, and divides the upper first chamber 117 frontwardly and rearwardly, thereby forming a space 125 in front of the third separator 113. The second input pipe 124 penetrates the third separator 113 and the front wall part 115, and extends in the axial direction of the outer casing 110 to the upper first chamber 117, which has a reduced capacity relative to the lower first chamber 121. The second input pipe 124 is connected to the rear end portion 84 of the rear exhaust pipe 64 to supply an exhaust gas exhausted from the rear bank 55, to the upper first chamber 117 which has a capacity reduced by the third separator 113. The through holes 127 are opened in the first separator 111 at a part facing the space 125 to allow communication of an exhaust gas between the space 125 and the lower first chamber 121. The first catalyst unit 131 is provided in the lower first chamber 121, and the second catalyst unit 132 is provided in the upper first chamber 117. The communication hole 134 is opened in the first separator 111 at a position rearward of the first catalyst unit 131 and the second catalyst unit 132 to allow communication of an exhaust gas between the lower first chamber 121 and the upper first chamber 117. The lower joining pipe 136 penetrates the second separator 112, has multiple holes 135 on a side facing the lower second chamber 122, and leads an exhaust gas from the lower first chamber 121 to the lower second chamber 122. The upper joining pipe 138 penetrates the second separator 112, has multiple holes 137 on a side facing the upper second chamber 118, and leads an exhaust gas from the upper first chamber 117 to the upper second chamber 118. The lower tail pipe 143 has a lid part 141 at its front end portion and rear multiple holes 142 in its outer circumference. The lid part 141 is inserted into the lower tail pipe 143 so as to seal the lower joining pipe 136. The lower tail pipe 143 leads an exhaust gas from the lower second chamber 122 to the outside. The upper tail pipe 147 has a lid part 145 at its front end portion and rear multiple holes 146 in its outer circumference. The lid part 145 is inserted into the upper tail pipe 147 so as to seal the upper joining pipe 138. The lower tail pipe 143 leads an exhaust gas from the upper second chamber 118 to the outside.

The space 125 is used as part of the lower first chamber 121 of the expansion path 81 led from the front cylinder 61. Thereby, the capacity of the lower first chamber 121 of the expansion path 81 being led from the front cylinder 61 and constituting the silencer 65 is made larger than the capacity of the upper first chamber 117 being the expansion path 82 led from the rear cylinder 62.

Moreover, the lower first chamber 121 serving as the expansion path for one of the cylinders communicates with the upper first chamber 117 serving as the expansion path for at least one different cylinder of the cylinders through the communication hole 134 through which an exhaust gas passes.

The lower first chamber 121 and the upper first chamber 117 communicate with each other through the communication hole 134 through which an exhaust gas passes. Use of this communication hole 134 prevents an increase in the number of components and allows enhancement of an output of the engine 35 without deteriorating the rigidity of the silencer 65.

In the drawing, reference numeral 149 denotes an adapter pipe connecting between the second input pipe 124 and the rear exhaust pipe 64.

In the present embodiment, the first separator 111 divides the outer casing 110 vertically. It should be noted, however, that the outer casing 110 may be divided left and right, or, according to the number of the cylinders, may be divided into three, four, five, or six in directions including an oblique upward direction and an oblique downward direction.

The silencer cover 75 is described below. The silencer cover 75 is a member placed outside the silencer 65 to cover the silencer 65. The silencer cover 75 is formed by integrally connecting a front cap member 151, a cover body 152, and a rear cap member 153 in this order from front to rear.

A support part 155 serving as a stay extends frontward from the front wall part 115 constituting a front end portion of the silencer 65. The front cap member 151 is attached to the support part 155 with a fastening screw 157.

A tail pipe 156 extends at a rear end portion of the silencer 65. The tail pipe 156 includes the lower tail pipe 143 and the upper tail pipe 147 that exhaust an exhaust gas to the outside. A stainless-steel mesh spacer 158 is attached around the tail pipe 156 to serve as a buffer. A sliding tubular part 161 provided on the rear wall part 116 side is inserted slidably into the mesh spacer 158. Accordingly, the silencer cover 75 is fixed at one point in the front end portion, as well as being supported slidably at the rear end portion by the tail pipe 156 so that the silencer cover 75 can adapt to a heat expansion of the silencer 65. In other words, the silencer cover 75 is slidably supported by the tail pipe 156 constituting a rear end portion 164 of the silencer 65.

In sum, the silencer cover 75 is formed of the front cap member 151, the cover body 152, and the rear cap member 153. The front cap member 151 forms a front portion and is a first cover part, while the cover body 152 and the rear cap member 153 are rearward of the front cap member 151 and are a second cover part. The first cover part (front cap member 151) is provided with the fixing support part 155, and the rear cap member 153 being part of the second cover part is provided with a slide structure 260.

By being placed between the tail pipe 156 and the sliding tubular part 161, the stainless-steel mesh spacer 158 serves as a buffer and fills the space formed between the silencer cover 75 and the silencer 65. Thereby, vibrations and sound possibly occurring between the rear end portion of the silencer cover 75 and the silencer 65 can be reduced.

The support part 155 supporting the silencer cover 75 is placed at a front end portion 163 of the silencer 65. The silencer cover 75 is placed so that portions other than the support part 155 may have a clearance from the silencer 65. This makes it hard for heat of the silencer 65 to be transmitted to the silencer cover 75, and also makes it hard for vibrations of the silencer 65 to be transmitted to the silencer cover 75.

The silencer cover 75 is made of metal and has its surface plated. The silencer cover 75 is fixed through the fixing support part 155 provided to the silencer 65. The tail pipe 156 at the rear end portion is provided in such a manner as to be slidable to the silencer cover 75. Accordingly, even if the silencer 65 expands by heat of an exhaust gas or the like to extend rearward with the fixing support part 155 fixed as a base, the silencer cover 75 can adapt to the heat expansion.

The silencer cover 75 is fixed to the silencer 65 through the support part 155 provided at the front end portion 163 of the silencer 65, and the silencer 65 is supported at the rear end portion 164 in such a manner as to be slidable relative to the silencer cover 75. Accordingly, compared to a case where the silencer 65 is slidably supported at a middle portion for example, the silencer cover 75 can be supported in a balanced manner, and a smooth heat expansion of the silencer 65 is allowed between the silencer 65 and the silencer cover 75. A balanced support of the silencer 65 allows a smooth heat expansion of the silencer 65 between the silencer 65 and the silencer cover 75.

Since the rear end portion 164 of the silencer 65 is the tail pipe 156, there is no need for an additional member such as a stay. Consequently, this simplifies the structure for allowing the silencer 65 to be slidable, preventing an increase in the number of components.

Figure 3:
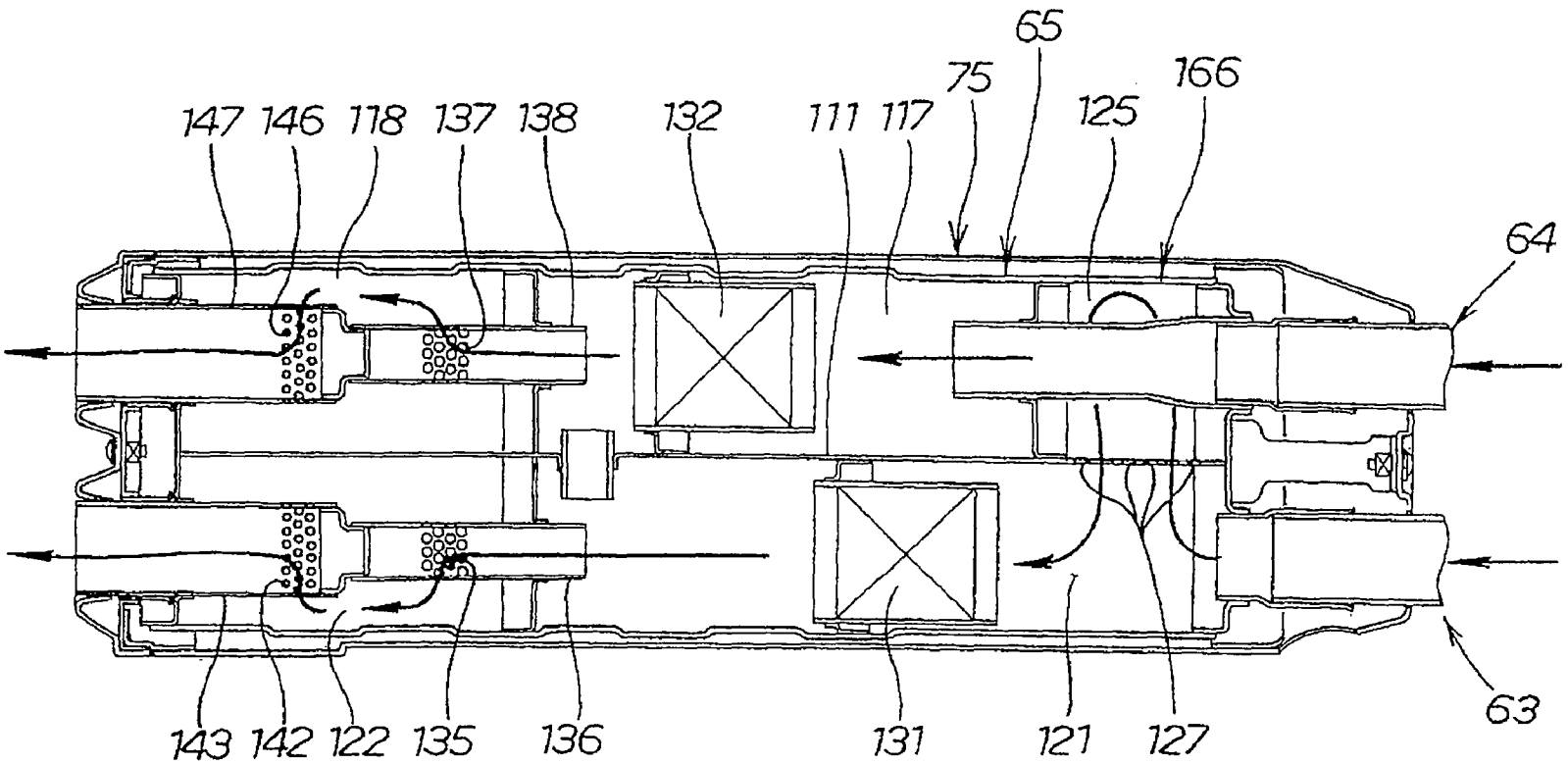
FIG. 3 is a view illustrating the operation of the saddle-ride type vehicle in FIG. 2.

In FIG. 3, an exhaust gas from the front exhaust pipe 63 flows to the lower first chamber 121 constituting the expansion chamber, and partially flows to the protruding space 125 protruding to a side of the upper first chamber 117, through the through holes 127 opened in the first separator 111. The exhaust gas in the lower first chamber 121 and the exhaust gas returning from the upper first chamber 117 together pass through the first catalyst unit 131. Then, the exhaust gas reaches the lower second chamber 122 through the multiple holes 135 provided in the lower joining pipe 136, enters the lower tail pipe 143 through the rear multiple holes 142 provided in the lower tail pipe 143, and is then discharged to the outside from the rear end portion of the lower tail pipe 143.

Meanwhile, an exhaust gas from the rear exhaust pipe 64 flows to the upper first chamber 117 constituting the expansion chamber, and passes through the second catalyst unit 132. Then, the exhaust gas reaches the upper second chamber 118 through the multiple holes 137 provided in the upper joining pipe 138, enters the upper tail pipe 147 through the rear multiple holes 146 provided in the upper tail pipe 147, and is then discharged to the outside from the rear end portion of the upper tail pipe 147.

Since the protruding space 125 is formed protruding from the lower first chamber 121, which is the expansion path for one of the cylinders, to the side of the upper first chamber 117, which is the expansion path for a different one of the cylinders, the lower first chamber 121 provided in the expansion path for the one cylinder has a capacity different from that of the upper first chamber 117 provided in the expansion path for the different cylinder. In other words, the upper first chamber 117 has a smaller capacity than the lower first chamber 121. Thereby, the upper first chamber 117 and the lower first chamber 121 can have different capacities without changing the overall capacity of the silencer 65.

When the protruding space 125, which is a part protruding to the side of the expansion path for the different cylinder, is called an protruding portion 166 of the one cylinder, the protruding portion 166 is placed between the multicylinder engine (V-type engine 35 side) and the upper first chamber 117 provided in the expansion path for the different cylinder is. When the lower first chamber 121, which is the expansion path led from the one cylinder, is provided close to the V-type engine 35, a pressure of an exhaust gas (exhaust back pressure) can be effectively reduced.

Also referring to FIG. 1, in the V-type engine 35 in which the front cylinder 61 and the rear cylinder 62 have a narrow angle therebetween with the crankshaft 53 being the center, the front cylinder 61 has a better intake efficiency than the rear cylinder 62. Therefore, the front cylinder 61 often has a higher output than the rear cylinder 62. According to the output difference between the front cylinder 61 and the rear cylinder 62, the capacity of the lower first chamber 121 of the expansion path led from the front cylinder 61 is made larger than the capacity of the upper first chamber 117 of the expansion path led from the rear cylinder 62, to thereby reduce the exhaust back pressure in the lower first chamber 121 being the expansion path. By reducing the exhaust back pressure, an output of the engine 35 can be improved. Further, an exhaust noise and output characteristics can be varied by increasing the output difference between the front and rear cylinders 61 and 62. Therefore, a further comfortable driving experience can be achieved.

In short, by adjusting the relative capacities of the individual chambers in the silencer 65, the capacity of the expansion path constituting the exhaust system of the multicylinder engine 35 can be changed for each cylinder. Accordingly, the performance of the engine 35 can be improved without increasing the size of the silencer 65. Note that the capacity is a volume that a container can hold.

Figure 4:
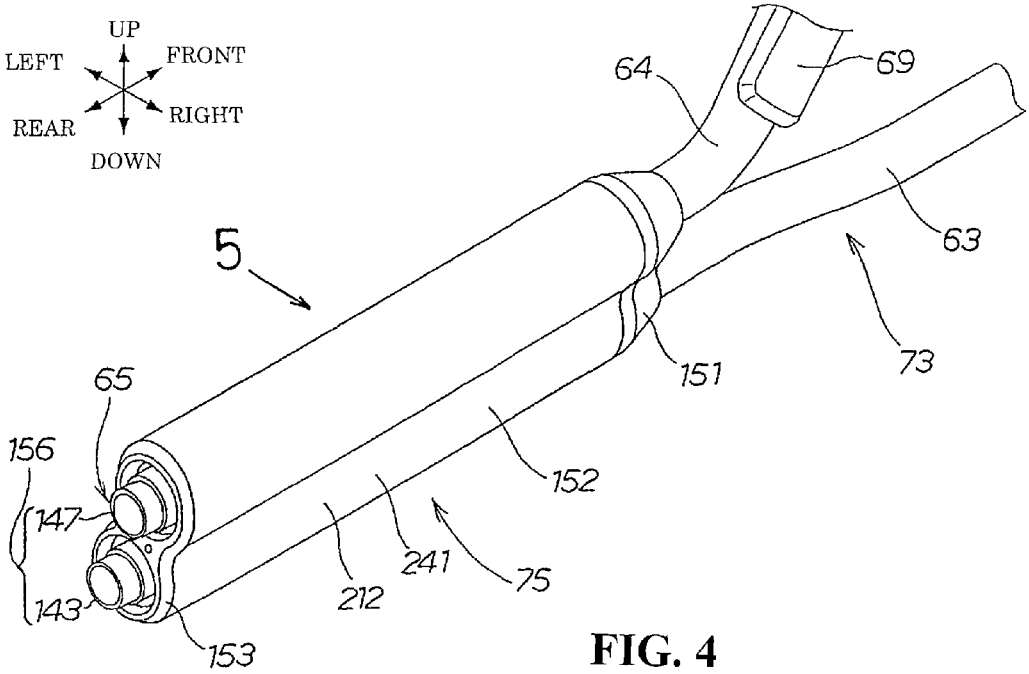
FIG. 4 is a perspective view of the silencer in the saddle-ride type vehicle according to the present invention.

In FIG. 4, the silencer 65 is covered from outside with the silencer cover 75 as a protection member. The silencer cover 75 is made of a metal and has its surface plated. Accordingly, the silencer cover 75 has an excellent appearance. In addition, as described in FIG. 2, the silencer 65 and the silencer cover 75 are placed away from each other to have a clearance therebetween, while the silencer cover 75 is supported at two points: its front end portion and rear end portion. Therefore, a temperature increase in the silencer cover 75 can be suppressed.

Figure 5:
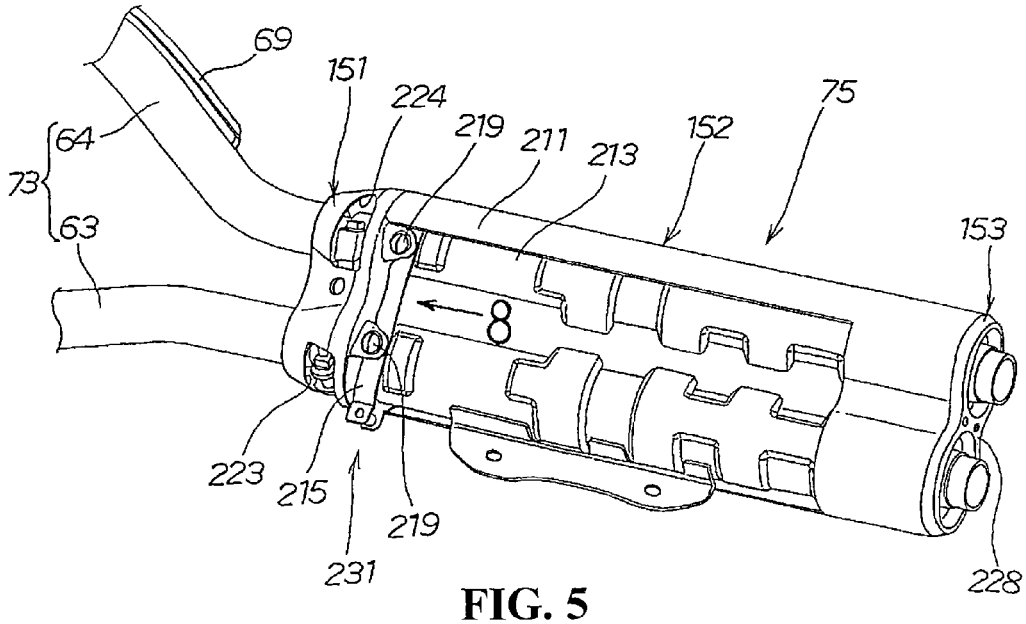
FIG. 5 is a view taken in an arrow 5 in FIG. 4.
Figure 6:
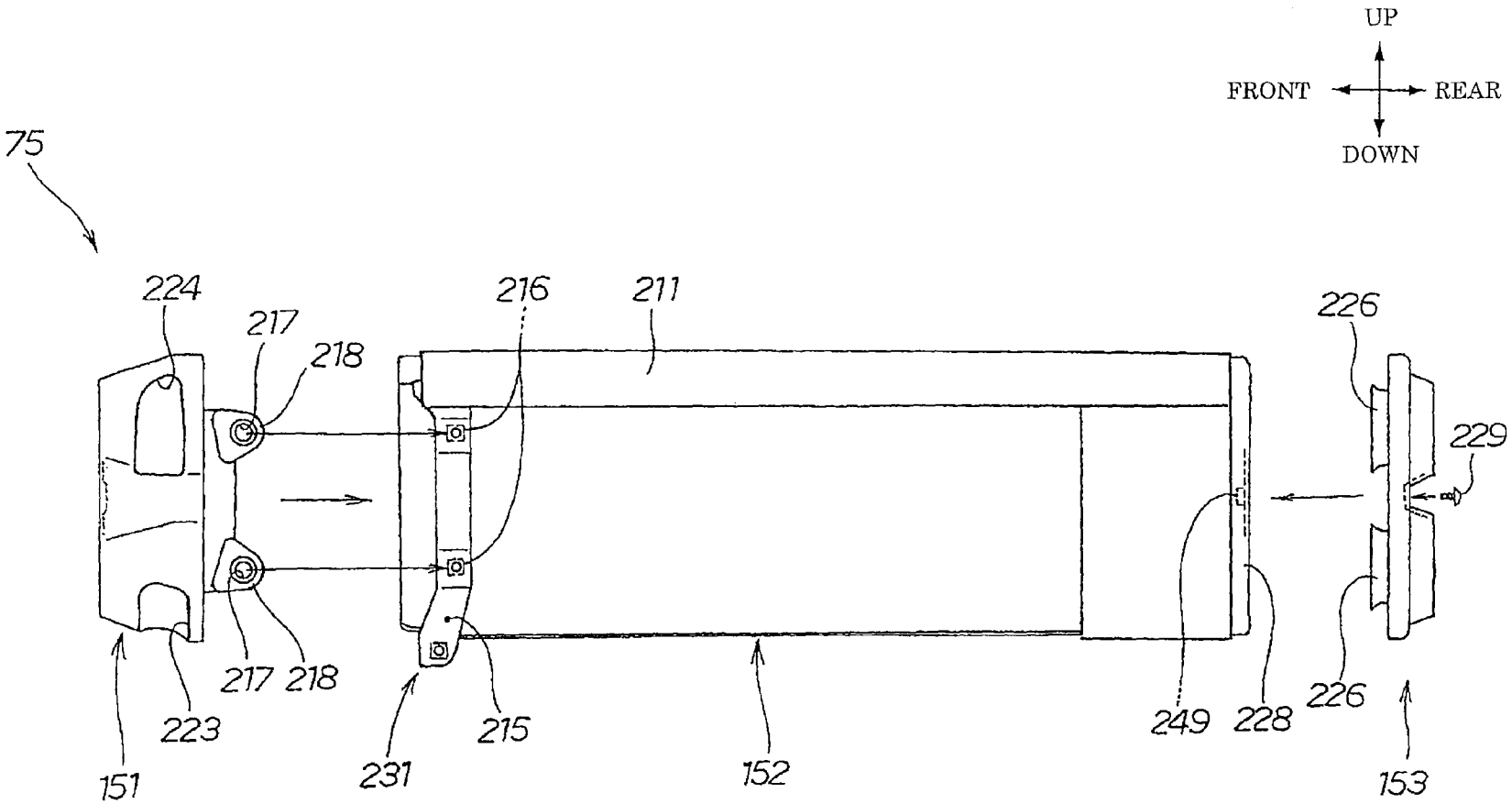
FIG. 6 is an exploded, side view of a silencer cover of the saddle-ride type vehicle according to the present invention.
Figure 7:
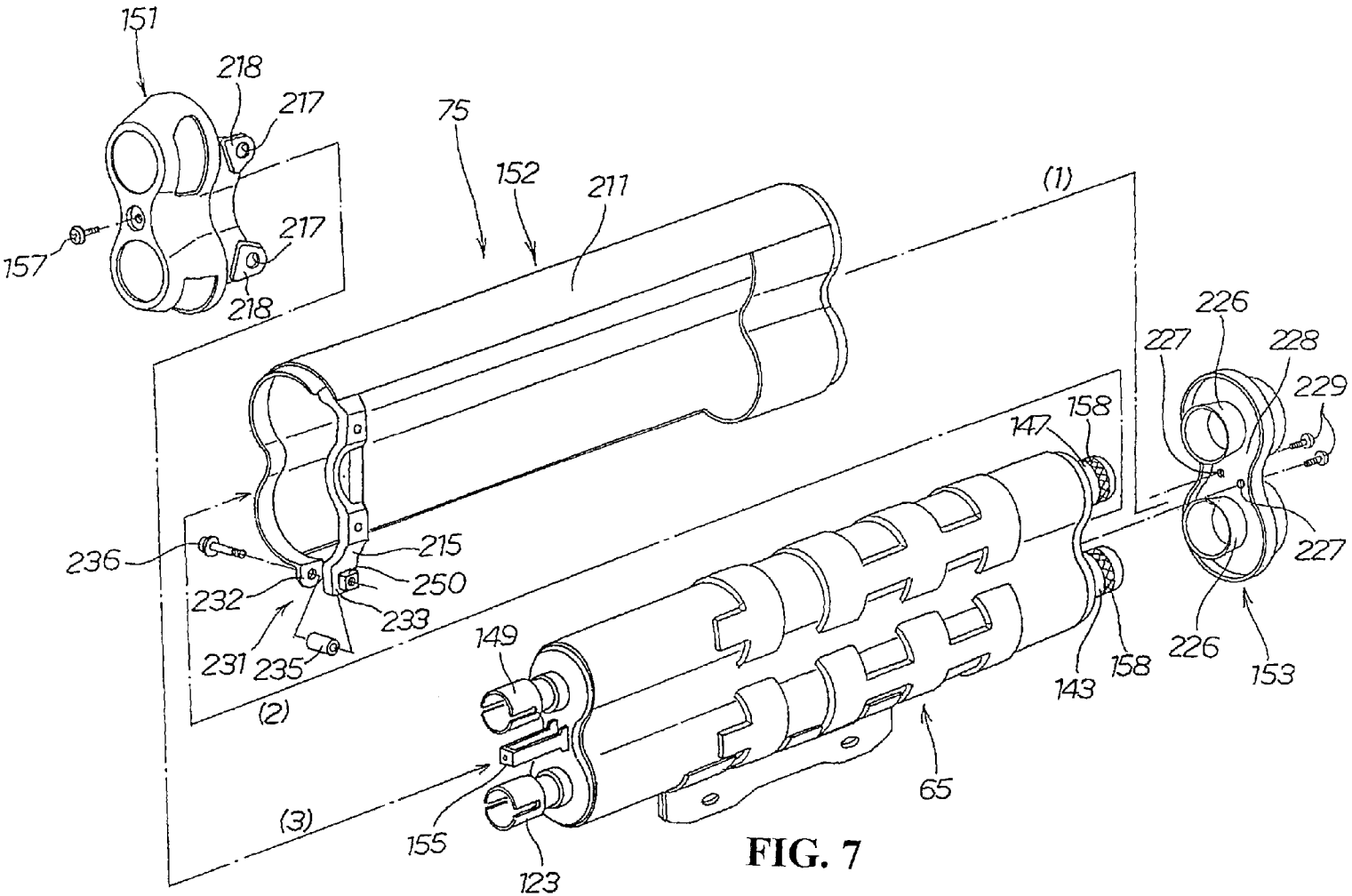
FIG. 7 is an exploded, perspective view of an exhauster of the saddle-ride type vehicle according to the present invention.

In FIGS. 5 to 7, the silencer cover 75 is formed of the cover body 152, the front cap member 151 attached to a front end portion of the cover body 152, and the rear cap member 153 attached to a rear end potion of the cover body 152.

The cover body 152, being a constituent member of the silencer cover 75, is provided with an extension part 211 that covers an outer side of the silencer 65 and that at least partially extends toward the vehicle. The silencer 65 is uncovered from its inner side to its top part. In other words, the silencer cover 75 covers an outer side 212 of the silencer 65, and uncovers a top part 213 of the silencer 65.

A front end portion of the cover body 152, which is the extension part 211, is provided with a split fastening part 215 that fastens the silencer cover 75 itself after installation of the silencer 65.

The split fastening part 215 is provided with weld nuts 216. The front cap member 151 includes attachment members 218 each having a hole part 217. The positions of the attachment members 218 correspond to those of the weld nuts 216. To attach the front cap member 151 to the cover body 152, the front cap member 151 is attached to the split fastening part 215 by aligning the hole parts 217 with the respective weld nuts 216 from an inner side of the silencer 65, and then by using fastening members 219. A rubber mount part is provided to each hole part 217 of the front cap member 151, so that the front cap member 151 and the cover body 152 are elastically supported. This makes it hard for vibrations of the front cap member 151 having the fixing part for the silencer 65 to be transmitted to the silencer cover 75.

The front cap member 151 is further provided with: a lower work hole 223 for holding a connection part of the front exhaust pipe 63 and the first input pipe 123; and an upper work hole 224 for holding a connection part of the rear exhaust pipe 64 and the adapter pipe 149 connected to the second input pipe 124. Thereby, attachability and detachability of the silencer 65 to and from the exhaust pipe 73 is ensured.

The tail pipe 156 (the lower tail pipe 143 and the upper tail pipe 147) provided to the silencer 65 is inserted into the rear cap member 153. The rear cap member 153 is provided with sliding tubular parts 226 that allow the respective tail pipes 143 and 147 to slide therethrough when the silencer 65 is heat-expanded. The slide structure 260 is formed between each of these sliding tubular parts 226 and a corresponding one of the lower tail pipe 143 and the upper tail pipe 147 to allow the silencer cover 75 to move relative to the support part 155 (fixing support part 155).

The slide structure 260 is formed between each of the sliding tubular parts 226 and a corresponding one of the lower tail pipe 143 and the upper tail pipe 147 to allow the silencer cover 75 to move relative to the support part 155.

In each of the sliding tubular parts 226, the inner diameter of the front end portion is larger than the inner diameter of the rear end portion. Making the inner diameter of the front end portion larger facilitates attachment of the tail pipes 143 and 147 to the respective sliding tubular parts 226.

In addition, left and right holes 227 are opened in the rear cap member 153. The rear cap member 153 is attached to the cover body 152 by aligning the holes 227 with positions of the respective weld nuts 249 provided in a tail plate 228 forming the rear end potion of the cover body 152, and then by using screws 229.

The split fastening part 215 is provided with a first tab 232 and a second tab 233 that constitute a fastening part 231. A collar member 235 is placed between the tabs 232 and 233. A weld nut 250 is attached to the second tab 233. By screwing a bolt 236 through the first tab 232 and then the second tab 233, the split fastening part 215 is fastened.

Since the split fastening part 215 fastens the silencer cover 75 itself with the collar member 235, a clearance is maintained between the silencer 65 and the silencer cover 75. This makes it hard for the vibrations of the silencer 65 to be transmitted to the silencer cover 75, and a temperature increase in the silencer cover 75 can be suppressed.

The silencer cover 75 having the above-described structure offers the following effects.

The silencer cover 75 covers the outer side 212 of the silencer 65. Covering the outer side 212 of the silencer 65 and uncovering the top part 213 of the silencer 65, the silencer 75 can allow an improvement in the radiation performance of the silencer 65. In addition, the silencer cover 75 is provided, at least partially, with the extension part 211 extended toward the vehicle, and this extension part 211 is provided with the split fastening part 215. The silencer cover 75 is fastened with this split fastening part 215, thereby facilitating work of attaching the silencer cover 75 to the silencer 65.

In FIG. 7, a description is given of how the exhauster according to the present invention is assembled. First, the rear cap member 153 is attached to the cover body 152 with the screws 229. Then, the tail pipes 143 and 147 which constitute the silencer 65 and around which the mesh spacers 158 are attached are press-fitted into the respective sliding tubular parts 226 provided to the rear cap member 153. Next, the split fastening part 215 is fastened with the bolt 236, and the front cap member 151 is attached to the split fastening part 215. Lastly, with the fastening screw 157, the front cap member 151 is attached to the support part 155 provided to the silencer 65. The assembly is thus completed.

Next, a description is given of the operations of the silencer cover 75 described above. Referring to FIGS. 1, 2 and 4 to 7, at least one of the points at which the silencer cover 75 is attached to the silencer 65 is a slide structure 260. Accordingly, when the silencer 65 is heat-expanded, the silencer 65 moves relative to the silencer cover 75. Thus, when the silencer 65 is heat-expanded, such relative motion allows the silencer cover 75 to be less affected by the heat expansion force from the silencer 65.

Moreover, the silencer cover 75 is made of a metal and has its surface plated. Conventionally, a silencer cover is formed with a combination of a metallic protector member and a resinous protector member. The radiation performance of the silencer cover is ensured by making the top part of the metallic protector member exposed to the outside, and the appearance of the silencer cover is improved by the resinous protector member.

However, an increased number of component members is required to be attached in some cases when the silencer cover is formed with a combination of members made of different materials.

In contrast, in the present invention, the silencer cover 75 is formed with only a metal, allowing reduction in the number of component members to be attached. In addition, an excellent appearance is ensured since a surface 241 of the silencer cover 75 is plated. Here, since the silencer cover 75 is open at its top part, heat escapes to above the top part, allowing an excellent radiation performance.

Furthermore, the silencer cover 75 is fixed with the fixing support part 155. Consequently, an amount of heat transmitted from the silencer 65 to the silencer cover 75 can be reduced to suppress a temperature increase in the silencer cover 75. When the temperature increase in the silencer cover 75 is suppressed, there is no worry that a plated layer formed on the surface 241 of the silencer cover 75 is deformed due to the temperature increase. Accordingly, an excellent appearance can be maintained. Therefore, with the silencer cover 75 of the present invention, the number of attached components for the assembly can be reduced, while maintaining excellent radiation performance and appearance.

Figure 8:
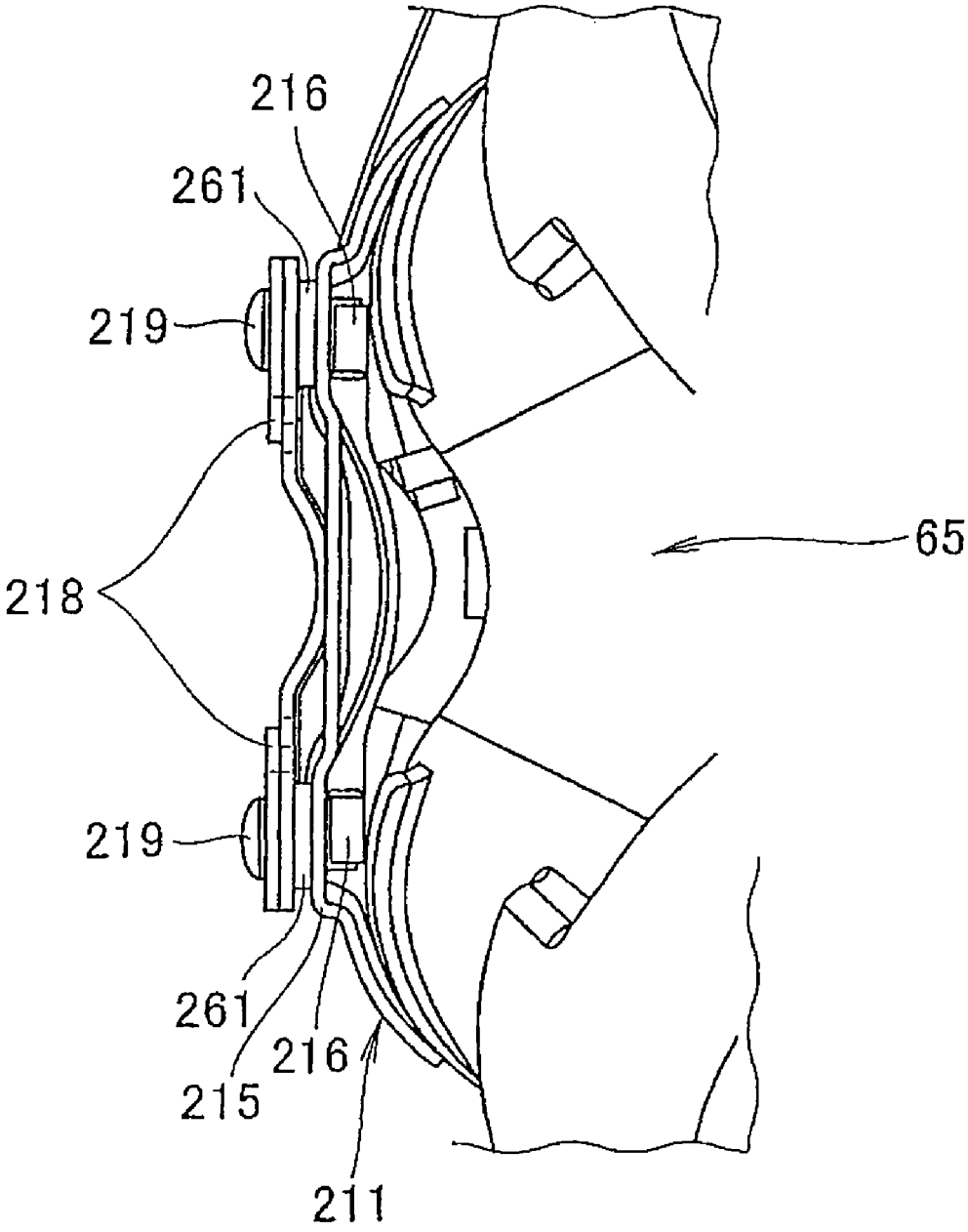
FIG. 8 is a view taken in an arrow 8 in FIG. 5.

In FIG. 8, with an elastic member 261, the front cap member 151 being the first cover part and being provided with the fixing support part (reference numeral 155 in FIG. 2) is connected to the cover body 152 being part of the second cover part and being provided with the slide structure. In other words, the cover body 152 is rubber-mounted to the front cap member 151. Consequently, such a rubber mount can make it harder for vibrations from the front cap member 151 provided with the fixing support part 155 to be transmitted to the silencer cover 75.

With the silencer cover and the silencer cover structure according to the present invention, the silencer can be covered almost entirely with only the front end portion and the rear end portion of the silencer supported. Accordingly, the silencer cover can be used in various types of saddle-ride type vehicles having different appearances without making any change to the silencer itself, but by changing only the appearance of the silencer cover. Accordingly, versatility of the overall silencer can be enhanced.

In the embodiment, the present invention is applied to a motorcycle. It should be noted, however, that the present invention can be applied to a three-wheeler and a four-wheeler, and may also be applied to a general vehicle.

The silencer cover of the present invention is preferably used as a cover for a silencer of a motorcycle.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A silencer apparatus, comprising:

a silencer connectable to a downstream end of an exhaust pipe of an engine, and a silencer cover covering said silencer, wherein said silencer cover is attached to said silencer at a plurality of contact points, wherein at least one contact point among said plurality of contact points includes a slide structure, and wherein said slide structure comprises a sliding tubular structure which surrounds a tail pipe of said silencer such that said sliding tubular structure can slide relative to said tail pipe, wherein said silencer includes a fixing support part for supporting said silencer cover, and wherein said fixing support part is disposed at a front end portion of said silencer, in a vehicle front-rear direction.

2. The silencer apparatus according to claim 1, wherein said slide structure is disposed at least at a rear end portion of said silencer.

3. The silencer apparatus according to claim 2, further comprising a mesh spacer disposed between said rear end portion of said silencer and said silencer cover.

4. The silencer apparatus according to claim 2, wherein said silencer cover includes a first cover part and a second cover part behind said first cover part, wherein said fixing support part is attached to said first cover part, wherein said slide structure is attached to at least said second cover part, and wherein said first cover part and said second cover part are connected to each other with an elastic member therebetween.

5. The silencer apparatus according to claim 1, further comprising a mesh spacer disposed between a rear end portion of said silencer and said silencer cover.

6. The silencer apparatus according to claim 1, wherein said silencer cover includes a first cover part and a second cover part behind said first cover part, wherein a fixing support part is attached to said first cover part, wherein said slide structure is attached to at least said second cover part, and wherein said first cover part and said second cover part are connected to each other with an elastic member therebetween.

7. The silencer apparatus of claim 6, wherein said silencer is capable of being mounted on a side of a motorcycle, and wherein a side of said first cover part facing towards the motorcycle includes a working hole in which a connection between the exhaust pipe and said silencer can be held.

8. The silencer apparatus of claim 6, wherein said second cover part includes a split fastening part in a part thereof which is adjacent to said first cover part.

9. The silencer apparatus of claim 1, wherein said silencer is capable of being mounted on a side of a motorcycle, wherein said silencer cover covers a side of said silencer facing away from the motorcycle, and wherein said silencer cover does not cover a side of said silencer facing towards the motorcycle.

* * * * *